United States Patent [19]

Bergland

[11] Patent Number: 4,616,827

[45] Date of Patent: Oct. 14, 1986

[54] PLAYING BALL

[76] Inventor: James H. Bergland, 102 York, St. Louis, Mich. 48880

[21] Appl. No.: 643,445

[22] Filed: Aug. 23, 1984

[51] Int. Cl.[4] ..... A63B 65/00; A63B 41/00

[52] U.S. Cl. ..... 273/58 A; 273/58 B; 273/58 K; 273/428; 273/DIG. 8; 273/65 EE; 273/65 EC; 273/60 R

[58] Field of Search ..... 273/58 K, 428, 128 A, 273/58 A, 58 B, 65 EE, 424, 65 EC, 60 R

[56] References Cited

U.S. PATENT DOCUMENTS

| | | | |
|---|---|---|---|
| 810,234 | 1/1906 | Sarkett | 273/428 |
| 1,299,092 | 4/1919 | Abrahamson | 273/55 |
| 2,362,064 | 11/1944 | Giesinger | 273/58 K |
| 2,640,699 | 6/1953 | Garbo | 273/424 |
| 2,864,201 | 12/1958 | Leise | 273/424 X |
| 3,185,476 | 5/1965 | Fechner | 273/58 K |
| 3,550,940 | 12/1970 | Ball | 273/65 |
| 4,114,885 | 9/1978 | Morrow | 273/424 |
| 4,244,584 | 1/1981 | Viveiros | 273/58 K X |
| 4,262,911 | 4/1981 | Opresik et al. | 273/58 K X |

FOREIGN PATENT DOCUMENTS

| | | | |
|---|---|---|---|
| 753972 | 10/1933 | France | 273/424 |

*Primary Examiner*—George J. Marlo

*Attorney, Agent, or Firm*—Miller, Morriss & Pappas

[57] ABSTRACT

A playing ball for kicking, throwing, spinning, or rolling, and combinations of these having an outer skin formed by three geometric portions, a central cylindrical disc having a diameter of about nine units of measurement and a pair of flanking dome shaped parabolic portions connected to the cylindrical central portion and both of the domes on the same principal axis as the cylindrical center portion and smoothly connected thereto.

6 Claims, 13 Drawing Figures

FIG. 5
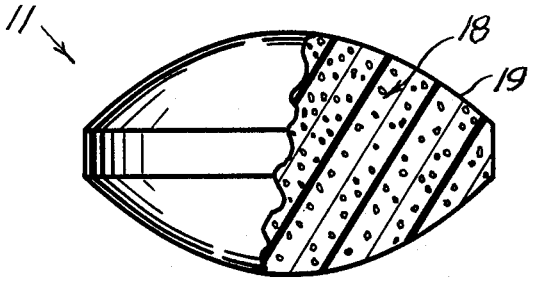
FIG. 6
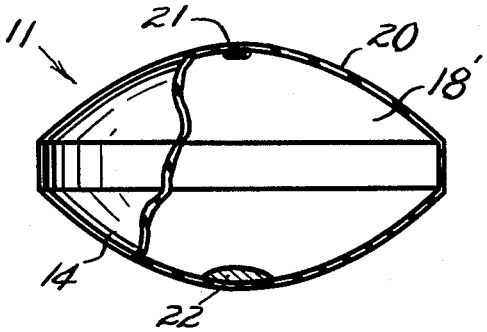
FIG. 7
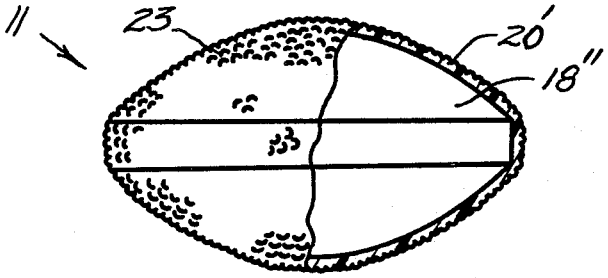
FIG. 8
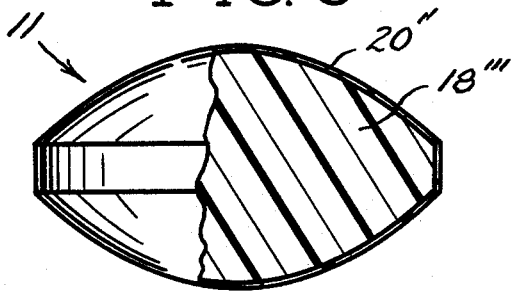
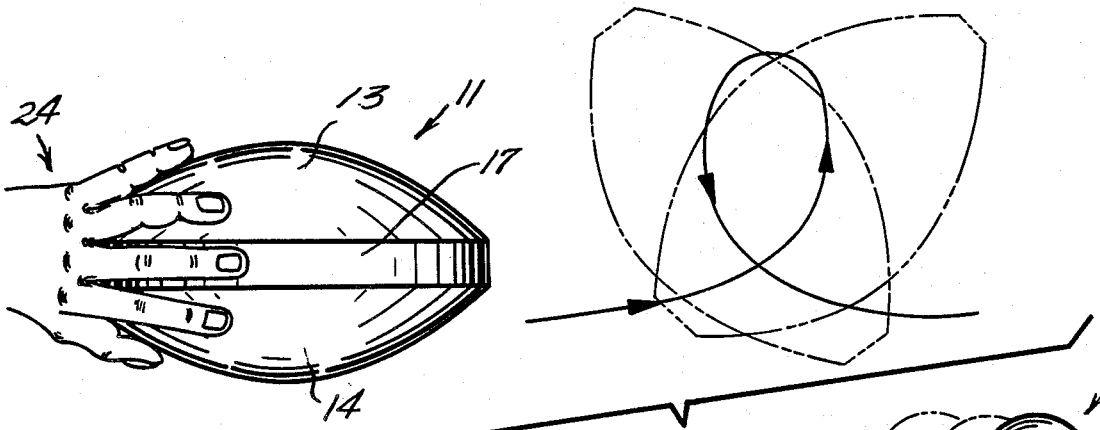
FIG. 9
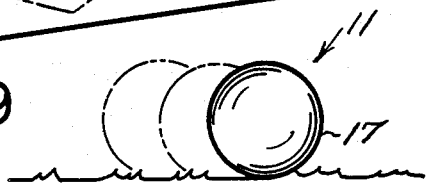
FIG. 10
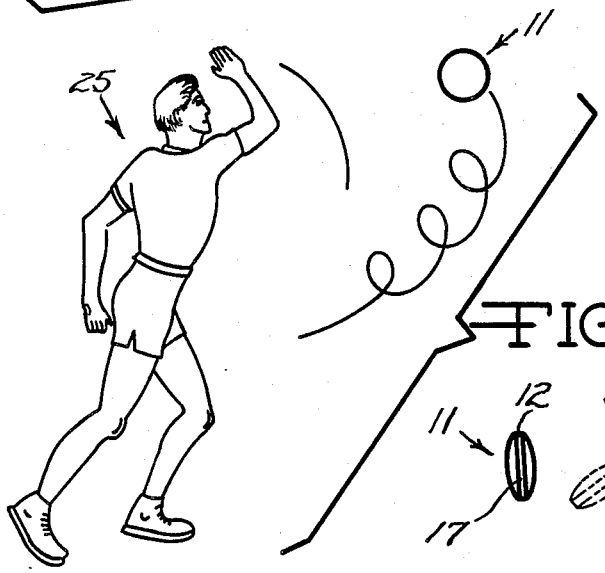
FIG. 11
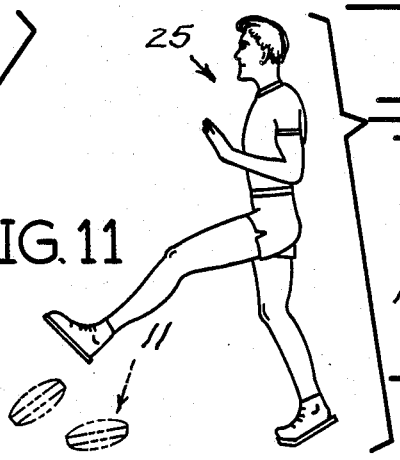
FIG. 12
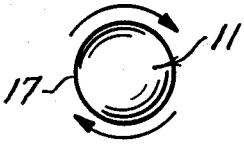
FIG. 13

PLAYING BALL

The present invention relates to a playing ball structured and configured to provide new forms of athletic enjoyment for children and adults of all ages. The playing ball differs in substantial particulars from all balls of known types while fragmentally admitting of functions found in many playthings that are thrown, kicked, bounced, rolled, and sailed. Depending upon the usage of the new playing ball, its dynamics cause it to behave regularly, where desired, or erratically as when chance or selection places the ball in a tumbling attitude.

A ball, viewed as a projectile, is an aerodynamic structure which reacts and is reacted upon by friction from air or winds, by frictional impact from engagement, and by gripping with calculated throwing thrust as from the hand of a thrower.

New games, new competitions and usages can grow from new playthings and special balls. The present ball introduces new and compounded delights and twists challenging the imagination of innovative users.

Hence, the principal object is to produce a new ball combining new performance for extended pleasure in homes, playgrounds, gymnasiums, backyards, streets, and beaches. It has special attraction for the young as a consequence of its compounding of regular and erratic performance.

The closest known ball structures are found in the U.S. Pat. No. 3,550,940 to Charles F. Ball comprising a Placement Kicking Ball Weighing Approximately 7 to 16 Ounces intended to be placed on the ground and kicked as with the intent to train place kickers. It has the approximate length of a football and conical tapering ends with an outside diameter of less than one-third of the length in a total weight range between about seven to 16 ounces.

The Hand Ball of U.S. Pat. No. 1,299,092 of Jacob Abrahamson has a rectilinear configuration of polyhedric dimension presenting plural facet-like planar surfaces.

None of these prior known devices show or suggest a playing ball having top and bottom domes and intermediate disc portions with the versatility and enjoyment range as in the presently described device.

IN THE DRAWING

FIG. 5 is a partially exploded side elevation of a playing ball in accord with the present invention and indicating a sponge rubber-like core to provide inherent bounce to the playing ball.

FIG. 6 is a modified version of the playing ball shown in side elevation in that a skin forms the outer shape of the ball and the hollow core is inflated with air as through the valve entry at the top of the ball, as shown, and the structure is counterweighted internally to equalize the weight of the top and lower dome portions, as shown.

FIG. 7 shows a partially cut away side elevation of the playing ball and indicates a pebbled or grained outer skin configuration in a hollow ball in accord with the present invention.

FIG. 8 shows a partially cut away side elevation playing ball of the playing ball which is filled with an elastic material imparting bounce, solidity and weight to the playing ball.

FIG. 9 shows in side elevation view the playing ball of the present invention grasped in the hand of a typical player and indicating an option of throwing in a flopping, tumbling manner.

FIG. 10 is a side elevation view of the playing ball of the present invention being rolled on the ground with the principal axis of the ball parallel to the ground and with the bellyband in rolling engagement with the ground.

FIG. 11 is a side elevation view of a player spinning the playing ball using an underhand thrust with substantially the same grip as in FIG. 9.

FIG. 12 is a side elevation of a player kicking the playing ball in an end-over-end manner causing the playing ball to flop over, as indicated, as contrasted to a kick which rolls the ball as in FIG. 10.

FIG. 13 is a top plan view of the playing ball of the present invention in which the ball is spinning around its principal axis while travelling through the air.

GENERAL DESCRIPTION

In general, the present invention comprises a playing ball characterized in that three geometric shapes are combined to form a circular or round ball in plan and a parabolically generate oblong shape viewed from the side or end made up of a pair of dome portions having the curvalinear outer surfaces of a paraboloid. The central portion is a circular disc or cylinder which smoothly joins the two dome-like shapes. The central disc portion has its axis on the line forming the principal axis of the structure and its outer surface defines a bellyband or band of about one unit of measure wide. The outermost portion of the domes at the principal axis are about two units above the joinder to the central disc and the base of the dome is about nine units in diameter, the diameter of the central disc. The ball is intended to be bounced and may be simply a hollow shell defined by the outer skin; it may be an inflated structure; it may be a sponge of bouncy material like sponge rubber or urethane foam; and it may be solid as with rubber or rubber-like elastomeric materials. In the hollow form the playing ball may be inflated to a selected use pressure as by a valve implant and by use of a counterweight to maintain the static and dynamic balance of the playing ball. The outside of the playing ball may be textured to enhance grip and frictional engagement with air or hands, bats or sticks. The playing ball may be thrown in end-over-end tumbling relation or may be spun or sailed to simulate a spinning platter while advancing through the air. The ball may be rolled on the ground or other surfaces as the creativity of the player and the manner of playing may dictate. The ball can be struck by bats or sticks. The games playable using the playing ball are limited only by imagination and creativity in the players. A form of "catch" is possible; the soccer-hockey type games are playable; and even rudimentary baseball takes on new dimensions. The peculiar configuration and consequent performance of the ball excites young people to resort to a projection of creativity in inventing many, many new games and uses.

The ball should bounce well in whatever form it is prepared in as against walls, boards, boots, bats, and should be easily cast or thrown by hand.

SPECIFIC DESCRIPTION

Figure 1:
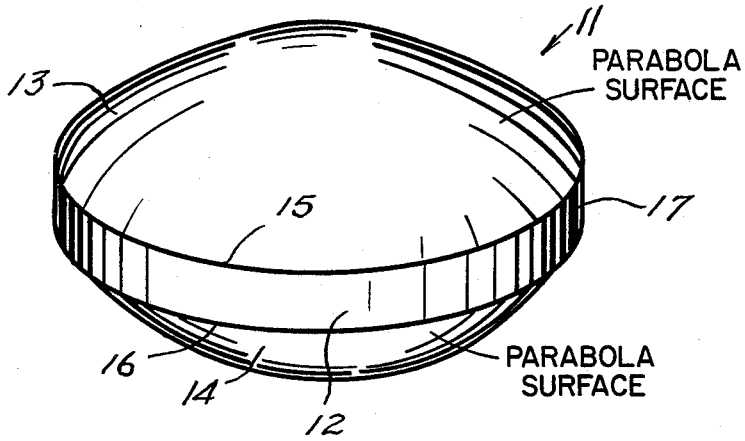
FIG. 1 is a perspective view of a playing ball in accord with the present invention.

Referring with particularity to the drawings and with first reference to the FIG. 1 thereof, the playing ball 11 is indicated in its typical outer configuration as comprising a central disc portion 12, an upper parabolic dome-like surface 13 and a lower parabolic dome-like surface 14 and connected to the disc portion 12 at perimeter intersections 15 and 16, respectively. Accordingly, a bellyband 17 defining a cylinder surface runs around the ball 11 and bears a shallow cylindrical relationship in the playing ball 11. The bellyband 17 and the disc portion 12 of the playing ball 11 are on a principal and central axis passing through the disc portion 12 and through the parabolic dome-like portions 13 and 14. Thus, the dome portions 13 and 14 have a common base diameter where they connect to the disc portion 12.

Figure 2:
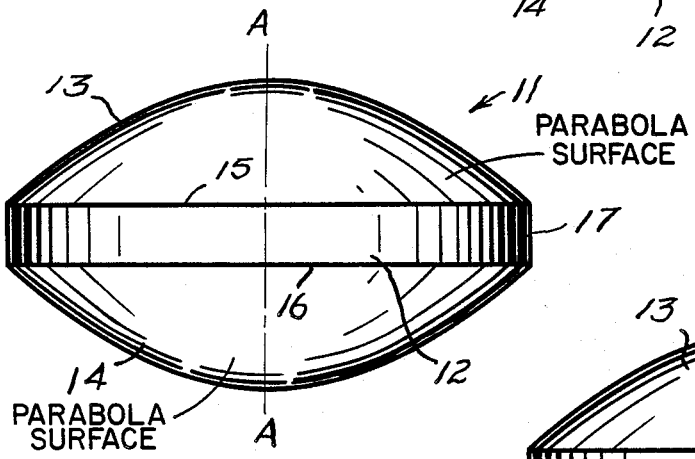
FIG. 2 is a side elevation view of the playing ball of FIG. 1.
Figure 3:
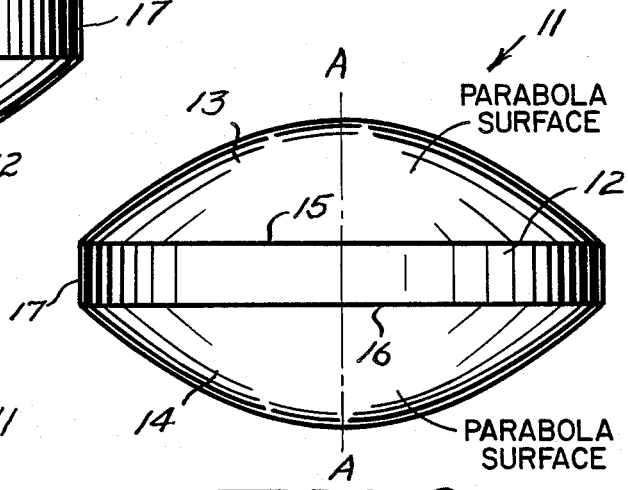
FIG. 3 is an end elevation view of the playing ball of FIG. 2 and indicating that the end, side and end elevation are substantially registrable.
Figure 4:
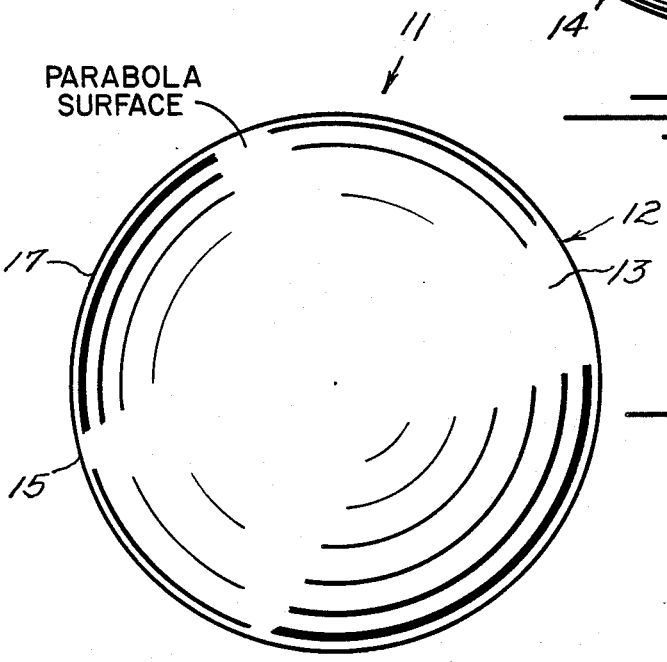
FIG. 4 is a top plan view of the playing ball of FIGS. 1, 2 and 3.

While the FIG. 1 is in perspective, the elevation views of the playing ball 11 in FIGS. 2 and 3 express that the domes 13 and 14 are of parabolic development and the approximate proportions of the structure can best be visualized as regular and symmetrical in both end and side views. The symmetry is seen on both sides of an imaginary plane passed transversely through the principal axis A—A. The bellyband 17 is one unit of measurement wide and the outermost peaks of the parabolic domes 13 and 14 stand off from the disc portion 12 for two units of measurement. The height of the playing ball 11 positioned as seen in FIGS. 2 and 3 on the principal axis A—A, is thus five units of measurement. The width of the playing ball 11, seen as a diameter in FIG. 4, is nine units of measurement. The playing balls 11 have preferred dimensions of a one inch bellyband 17, a five inch height on the principal axis A—A and a nine inch diameter at the round disc 12 located between the dome portions 13 and 14. These dimensions are found as happy means between and for the hand sizes of adults and children. Aerodynamically, the combination of disc and paraboloids create a controllable erratic stability that is a part of the total fascination of the playing ball 11.

FIGS. 5–8 indicate that the playing ball 11 may be formed for support in an integral manner (FIG. 5) in which the core portion 18 is filled with a sponge-like rubber or foamed urethane and where the forming is against peripheral molds forming an integral skin 19, as shown. The selection of core 18 (foam density) can adjust the weight and bouncing or resilient performance of the playing ball 11. The geometry of the FIG. 5 playing ball 11 conforms to the geometry described in FIGS. 1–4 and is found present in the constructions of FIGS. 6, 7 and 8. In FIG. 6 the playing ball 11 is inflatable and deflatable and while a bladder or diaphragm core may be used, the illustrated core 18' is a void formed by the closed form of the skin 20, as shown, and in which a valve 21 allows needle penetration for inflation. The counterweight 22 at the outermost part of the opposite dome and on the central and principal axis of the ball 11 provides a static and dynamic balance to the ball 11. Gas inflation (air or nitrogen, for example) to a selected hardness is accomplished quite simply in the manner of inflating basketballs, footballs and soccer balls.

The FIG. 7 shows a playing ball 11 having surface upsets as pebbling 23 which provides a friction generating surface or skin 20'. The core 18'' is shown empty indicating that the playing ball 11 of FIG. 7 may be preformed at a given inflating pressure, as a hollow playing ball structure, noninflatable.

The FIG. 8 indicates that playing ball 11 may comprise an integral or nonintegral skin 20'' cast or formed from a relatively solid block of selectively bouncy or resilient rubber, resin, or plastic material filling the core portion 18''', as shown. Any outer ornamentation relief or design can be applied by decorative coatings or molding or combinations thereof.

In FIG. 9 a playing ball 11 is shown in a preferred grip as for spinning or tumbling the ball 11 in thrown flight. As indicated, the middle finger of a hand 24 is positioned along the bellyband 17 causing the remainder fingers to fall on the domes 13 and 14. With a flip of the wrist in either an overhand or underhand motion, the playing ball 11 is made to tumble in the trace seen in FIG. 9. Likewise, it may be rolled or kicked on the bellyband 17 by a spinning imparted to the playing ball 11 and seen in the FIG. 11 by the player 25.

In FIG. 12 kicking the playing ball 11 may impart the suggested tumbling assuming that the impact of the toe of the player 25 is slightly beneath the bellyband 17 or disc portion 12. Variance in the thrust at impact may result in spinning, as illustrated in FIG. 13, and which may be combined with thrust direction to provide something akin to hooking or slicing in golf. Combining the stroke with footwork, the playing ball 11 may be erected as in FIG. 10 and be dribbled along, as in soccer, with the feet. Standing still and on the band 17, the playing ball 11 can be kicked axially or in a plane paralleling the disc portion 12.

The manufacture of the described devices may be by injection molding or casting using split molds with selected parting agents and well known materials for manufacture of playing balls. The casts may be ornamented if the playing balls are completed in the molding or casting. If not completed, then the smoothly joined skins may be filled, fitted with valves and counterweights, as required, and decorated or ornamented, all procedures well known in forming playing balls of various types.

In use, the playing balls of the present invention interject an uncertainty of movement that contributes to the charm of use in conventional type games such as throwing and catching, sailing or spinning and catching, passing, carrying and kicking as in football and impact games like baseball, hockey, rugby and soccer, as well as new inventive gamesmanship played solo, duo, or with team bases.

Having thus described my inventive structure and at least one preferred embodiment thereof, others skilled in the art will appreciate modifications, changes and improvements therein, and such modifications, changes and improvements are intended to be included herein limited only by the scope of my hereinafter appended claims.

I claim:

1. A playing ball having a circular center disc portion and having a parabola dome upper configuration and a parabola dome lower configuration, the base portion of said domes each peripherally connected to said disc.

2. A playing ball having a continuous outer surface defining an enclosure formed by a pair of upper and lower facing parabola dome portions connected to a coaxial center disc portion, said disc portion forming a peripheral narrow width band in a curvalinear plane around the principal axis.

3. A playing ball having a central disc portion which is cylindrical and having a width of one unit and a diameter of 9 units; and a pair of parabola domes, each having a circular base diameter of 9 units and a height of two units and said parabola domes smoothly joined to said disc portion at the perimeter circular edges thereof forming an enclosure.

4. The playing ball of claim 2 wherein said disc portion and said connected dome portions and said disc together define an enclosure having resilience and elasticity, said enclosure having external surface patterns to enhance grip and friction and having counterbalanced inflation means through said enclosure.

5. The playing ball of claim 2 wherein said enclosure comprises a skin and said skin is filled with rubber-like resilient material adhered to said skin.

6. The playing ball of claim 2 wherein said enclosure is a supported skin having a friction extending outer surface for a hand gripping position, at rest, on said dome portions and on said perimeter disc surface for selected throwing, spinning, kicking and rolling of said playing ball.

* * * * *